US007077239B1

(12) United States Patent
Hayman et al.

(10) Patent No.: US 7,077,239 B1
(45) Date of Patent: Jul. 18, 2006

(54) EXPANDABLE DUAL TUBE SCAFFOLD HATCH STRUCTURE

(75) Inventors: Yates W. Hayman, Walker, LA (US); Ken Hensley, St. Amant, LA (US); Robert E. Lea, Watson, LA (US)

(73) Assignee: Deltak Manufacturing, Inc., Walker, LA (US)

( * ) Notice: Subject to any disclaimer, the term of this patent is extended or adjusted under 35 U.S.C. 154(b) by 47 days.

(21) Appl. No.: 10/799,074

(22) Filed: Mar. 12, 2004

(51) Int. Cl.
*E04G 1/00* (2006.01)

(52) U.S. Cl. ..... 182/178.1; 182/222; 182/113

(58) Field of Classification Search ..... 182/178.1, 182/179.1, 186.7, 186.8, 223, 222, 119, 113
See application file for complete search history.

(56) References Cited

U.S. PATENT DOCUMENTS 1,508,392 A * 9/1924 Heun ..... 182/214
2,941,616 A * 6/1960 Grover et al. ..... 182/115
3,071,206 A * 1/1963 Kristen ..... 182/152
3,837,427 A * 9/1974 Mattinson ..... 182/115
4,426,171 A * 1/1984 Layher ..... 403/49
5,088,577 A * 2/1992 Pierce ..... 182/179.1
5,746,289 A * 5/1998 Williams ..... 182/129
5,988,318 A * 11/1999 Krause ..... 182/222
6,851,518 B1 * 2/2005 Walker ..... 182/107

* cited by examiner

*Primary Examiner*—Alvin Chin-Shue
(74) *Attorney, Agent, or Firm*—Jones, Walker, Waechter, Poitevent, Carrere & Denegre, L.L.P.

(57) ABSTRACT

The invention is a scaffold access system for use in a scaffold frame of horizontal and vertical scaffold members. The system includes double barrel scaffold horizontal member, a series of short scaffold boards, a series of long scaffold boards, a short vertical scaffold member, a safety gate, and a series of short horizontal members. The double barrel scaffold horizontal member has a upper tube and a lower tube joined in a vertical relationship and a third tube slidable in the lower tube. Each tube has an interior and an exterior end. The upper tube and the third tube have an attachment member positioned on its respective exterior end. The upper tube has an upstanding vertical stub, to which is attached the short vertical scaffold member. The short scaffold boards and the long scaffold boards are placed on the scaffold frame to define a scaffold deck with an access opening. A safety gate and short horizontal scaffold members are used in conjunction with the scaffold frame and vertical stub to define a gated safety rail around the access opening.

5 Claims, 12 Drawing Sheets

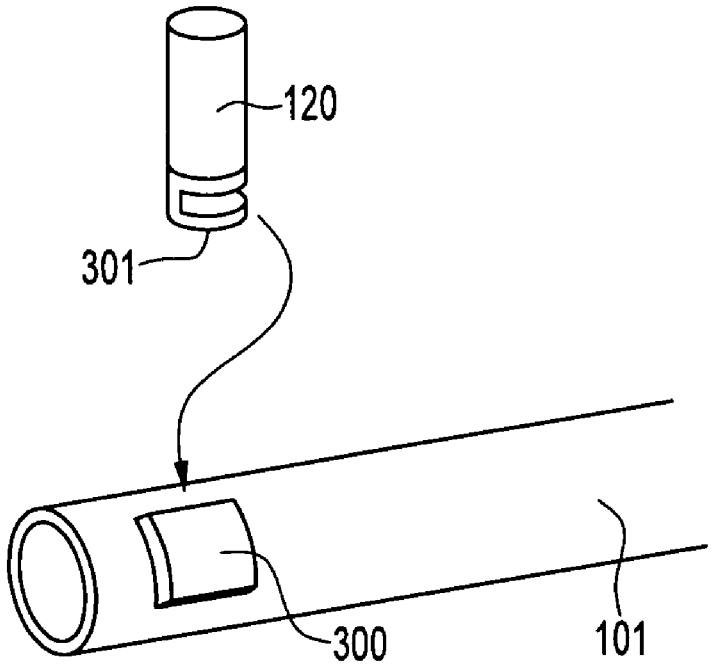
FIG. 8
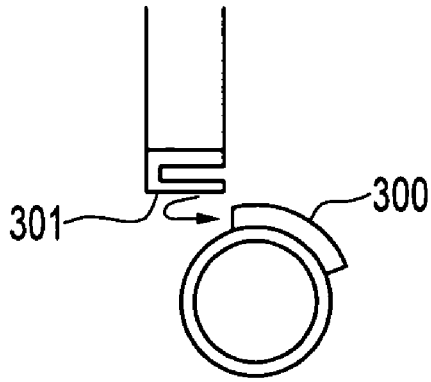
FIG. 8A (CROSS SECTION)

EXPANDABLE DUAL TUBE SCAFFOLD HATCH STRUCTURE

FIELD OF INVENTION

This invention relates to scaffolding devices, and in particular, to scaffold decking with access openings therein.

BACKGROUND OF INVENTION

Scaffolding creates platforms that provide a stable and safe structure for working at elevated heights. A scaffold structure includes horizontal members and vertical members that are assembled into a framework. At the desired height, scaffold boards are attached to scaffold structures to create a working platform or working surface. The scaffold boards can be wooden or metal boards that are supported on the structure by horizontal scaffold members. One scaffold system which allows for flexibility in the horizontal position of a scaffold platform is shown in U.S. Pat. Nos. 5,078,532 and 5,028,164, both to Williams (incorporated herein by reference). The Williams patents show vertical scaffold members with cups placed thereon with latchable horizontal members where the latches interlock the cups on the vertical members. This system, and other, allow for great flexibility in assembly of the scaffold structure and placement of the working surface. Generally, the scaffold structure extends above the deck surface to provide a safety rail system for workers on the deck.

A common problem with scaffolding is providing a safe means to access the elevated platform. Generally, a worker either climbs the assembled scaffold structure or a ladder is placed on the outside of the platform structure. In either case, the worker uses the exterior of the scaffold structure to access the scaffold working surface with attendant risks. One such scaffold ladder is shown in U.S. Pat. No. 6,415,891 to the applicant (incorporated herein by reference). As the scaffold structure generally extends above the platform working surface, workers either have to climb over the safety rails to access the working surface or the safety rails have to have a gap in the rail system to allow a worker to pass through the safety rail system. One such system employing an external ladder and a gap in the safety rail system is shown in U.S. patent application Ser. No. 09/767,569 to the applicant. Any exterior ladder, however, presents a risk to the climber—there are no intermediary levels to act as a stop in case of a fall. Other systems have been devised for accessing scaffold decks, including such as scaffold stairs, as shown in U.S. Pat. No. 6,044,930 to the applicant. Scaffold stairs can be cumbersome and heavy and, for a short term scaffold structure, may be more than needed.

Attempts have been made to safely accommodate a ladder in the interior of a scaffold structure. One such method being the placement of a framed opening on a scaffold platform to which a scaffold hatch is placed to allow the opening to be closed. One such scaffold hatch is shown in U.S. Pat. No. 5,746,289 to Williams (incorporated herein by reference). The scaffold hatch, however, is cumbersome and is not designed to support safety rails around the opening.

SUMMARY OF THE INVENTION

A scaffold access opening system is provided for accessing the working surface of a scaffold system through an opening in the working surface. The system includes a double barreled horizontal scaffold member which includes two partial horizontal members joined in a vertical relationship to create an upper and lower partial horizontal member, and a third tube which is slidable in the lower tube. The upper horizontal partial member and third tube include an attachment member on the exterior end for attaching to the scaffold frame. The upper partial horizontal member accommodates a vertical stub to which a vertical scaffold member is attached. The double barreled horizontal scaffold member is placed on the scaffold frame to create a dual level to intermediary horizontal member on the scaffold. Short scaffold boards are combined with long vertical scaffold boards in a scaffold frame on the horizontal elevation of the double barrel horizontal scaffold member to create a working platform with an access opening in the platform. The scaffold frame extends above the working platform. The system is designed to accommodate a safety rail around the access opening by incorporating a portion of the exterior scaffold frame as the safety rail and using an intermediate vertical scaffold member attached to the vertical stub on the double barrel horizontal scaffold member to create the needed interrial safety rail/safety gate.

OBJECTS OF THE INVENTION

It is an object of the invention to provide an apparatus to allow a worker to safely access a scaffold walking surface.

It is an object of the invention to allow a worker to safely access the walking surface of a scaffold through the interior of a scaffold system.

It is an object of the invention to provide access opening in a scaffold deck that accommodates a safety rail system around the access opening.

It is another object of the invention to provide a double barreled horizontal scaffold member to accommodate an area of partial decking and an area of full decking.

These and other objects, advantages, and features of this invention will be apparent from the following descriptions of the invention.

BRIEF DESCRIPTION OF THE DRAWINGS

FIG. 8 is a perspective view of a vertical stub showing the sleeve/tab relationship.

DETAILED DESCRIPTION OF THE INVENTION

Figure 1:
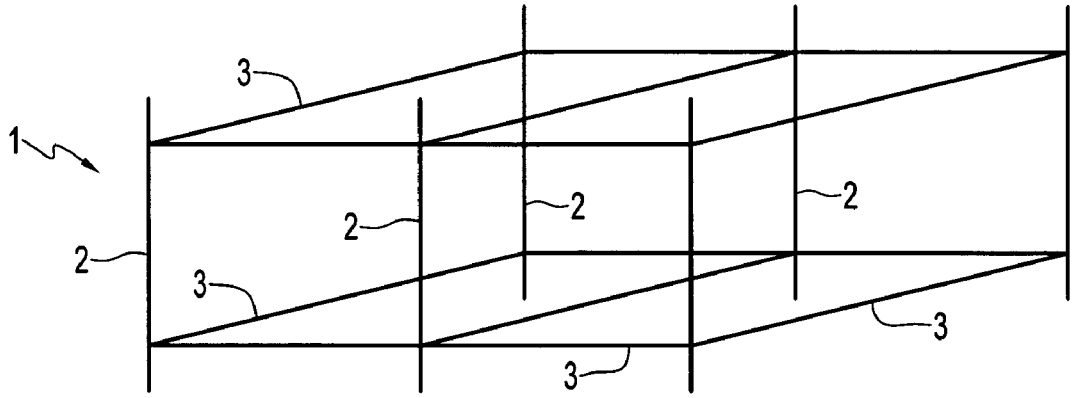
FIG. 1 is a schematic representation of a scaffold frame.
Figure 2:
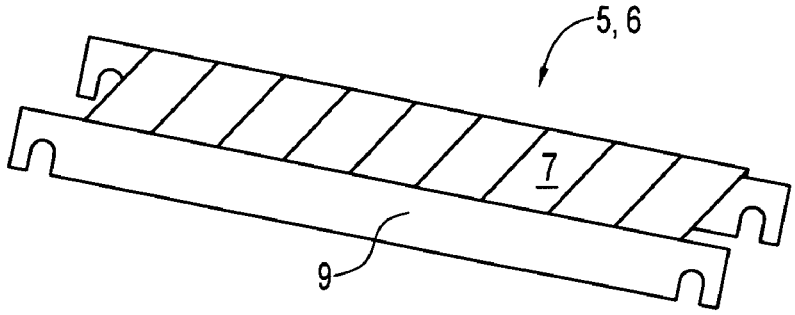
FIG. 2 is a perspective view of one type of metal scaffold board.

Shown in FIG. 1 is a scaffold structure 1 consisting of a series of vertical members 2 and horizontal members 3 assembled to form a frame. A platform 4 is placed on the structure. The platform consists of a series of scaffold planks 5 which rest upon horizontal members. Shown in FIG. 2 is a metal scaffold plank 6. The plank shown has a walking surface 7 and "U" shaped brackets adapted to engage a round or circular shaped horizontal scaffold member. The plank shown also has side ears 9 which help stiffen the plank. As shown, the "U" shaped brackets are cut-outs in the side ears 9. Generally, the scaffold frame extends above the scaffold platform or working surface to provide a safety rail to protect workers on the platform.

Figure 3:
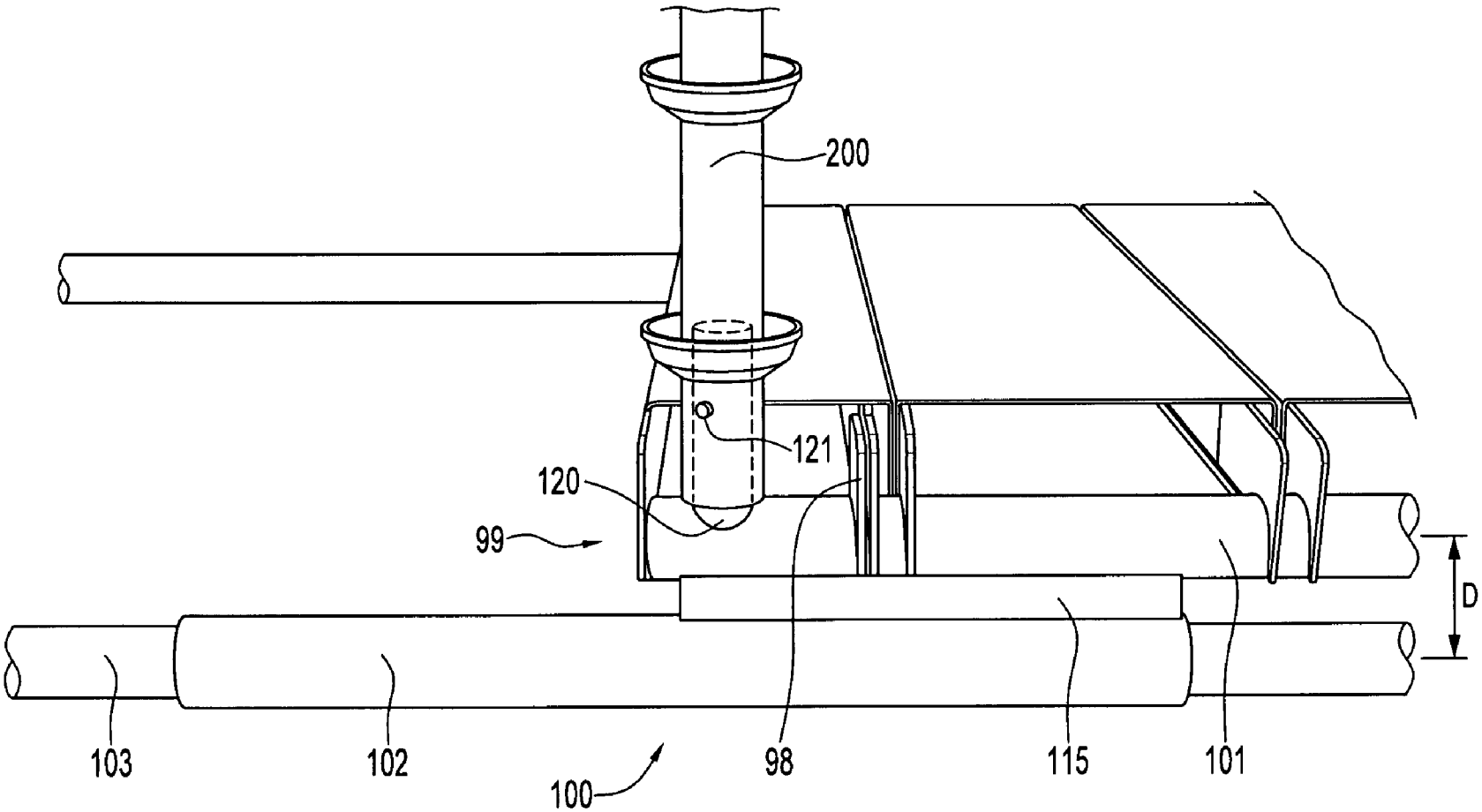
FIG. 3 is a perspective view of a center portion of the double barreled horizontal scaffold member.

Shown in FIG. 3 is the center portion of a double barreled horizontal scaffold member 100. The member has two tubes positioned in a vertical relationship: an upper tube 101 and a lower tube 102, each tube is considered a "partial" horizontal scaffold member, as each tube, in uses, is connectable to the scaffold frame at only one end. Both tubes are shown as circular in cross-section, but other shapes are possible. The centers of the two tubes are vertically offset a distance D. As shown, the upper tube is vertically aligned with the lower tube, but such is not necessary.

Lower tube 102 is a sleeve in which a third tube, an insert tube 103 slides. The slidable insert tube 103, in combination with the fixed upper tube 101, allows the double barrel horizontal scaffold member 100 to be lengthwise adjustable to allow the double barrel horizontal member to adjust to and bride a variety of scaffold structure's horizontal dimensions. Lower tube 102 and slidable insert tube 103 are a lower tube assembly. For constant fixed distances, the slidable insert tube 103 could be eliminated, in which case, the lower tube 102 would have an attachment member 110 positioned thereon, next described.

Figure 4:
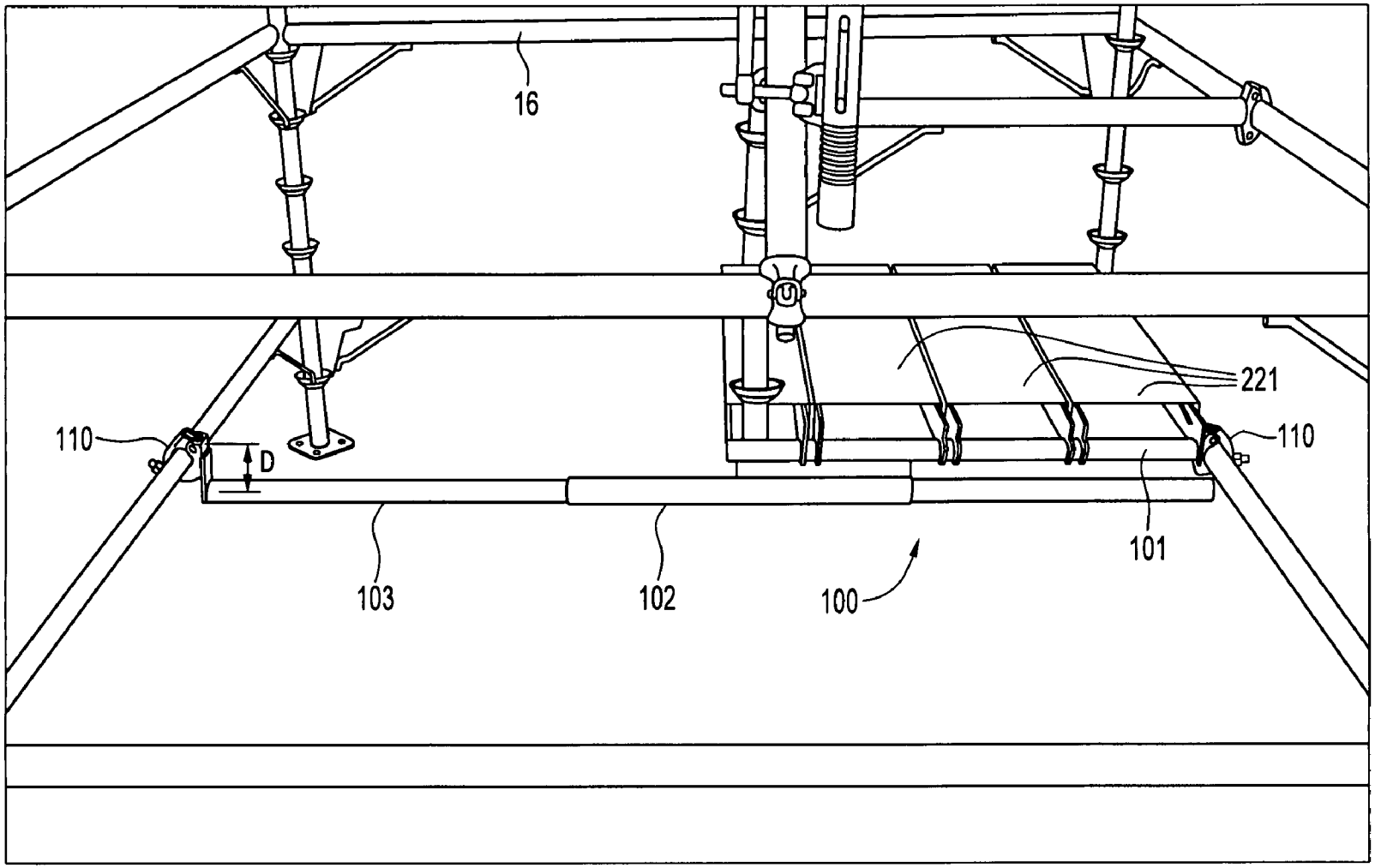
FIG. 4 is a perspective view of the installed double barreled horizontal scaffold member.
Figure 6A:
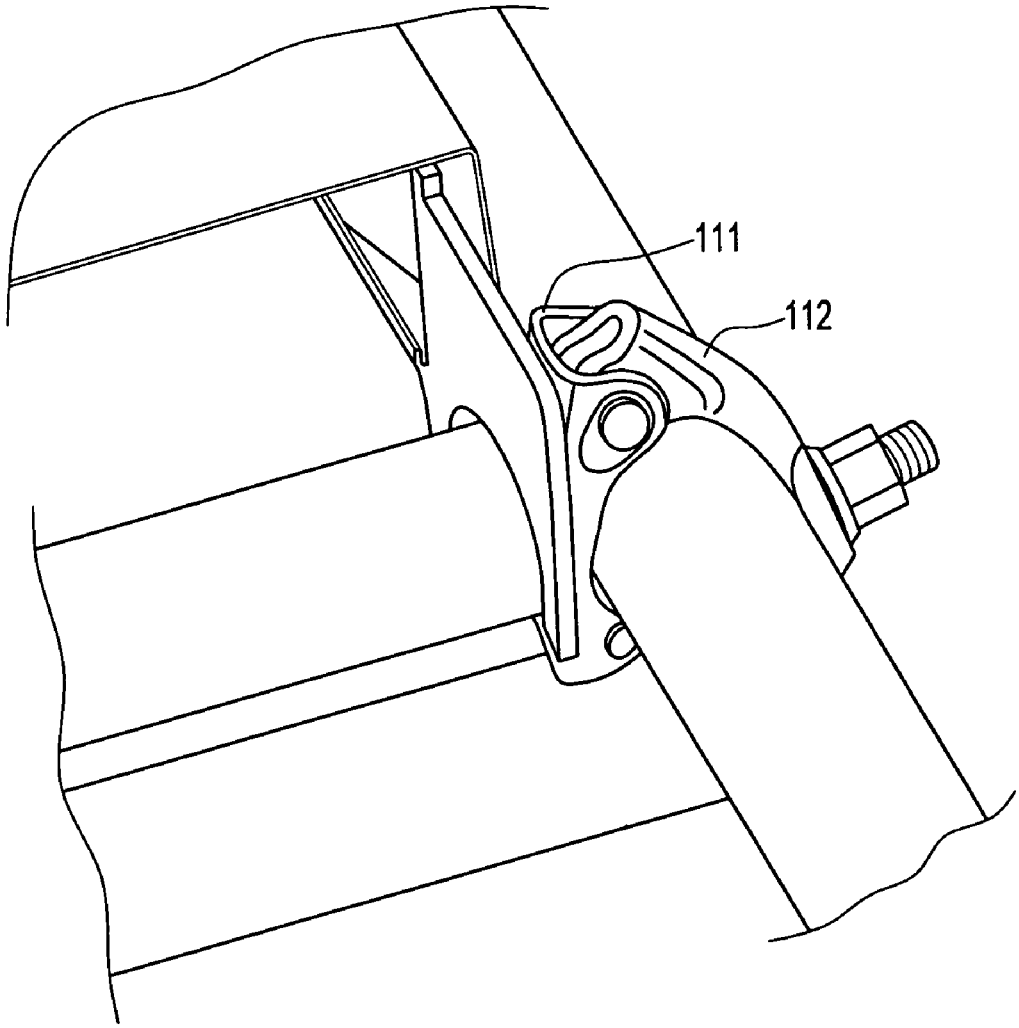
FIGS. 6A, 6B and 6C are perspective views of one embodiment of the attachment members.
Figure 6B:
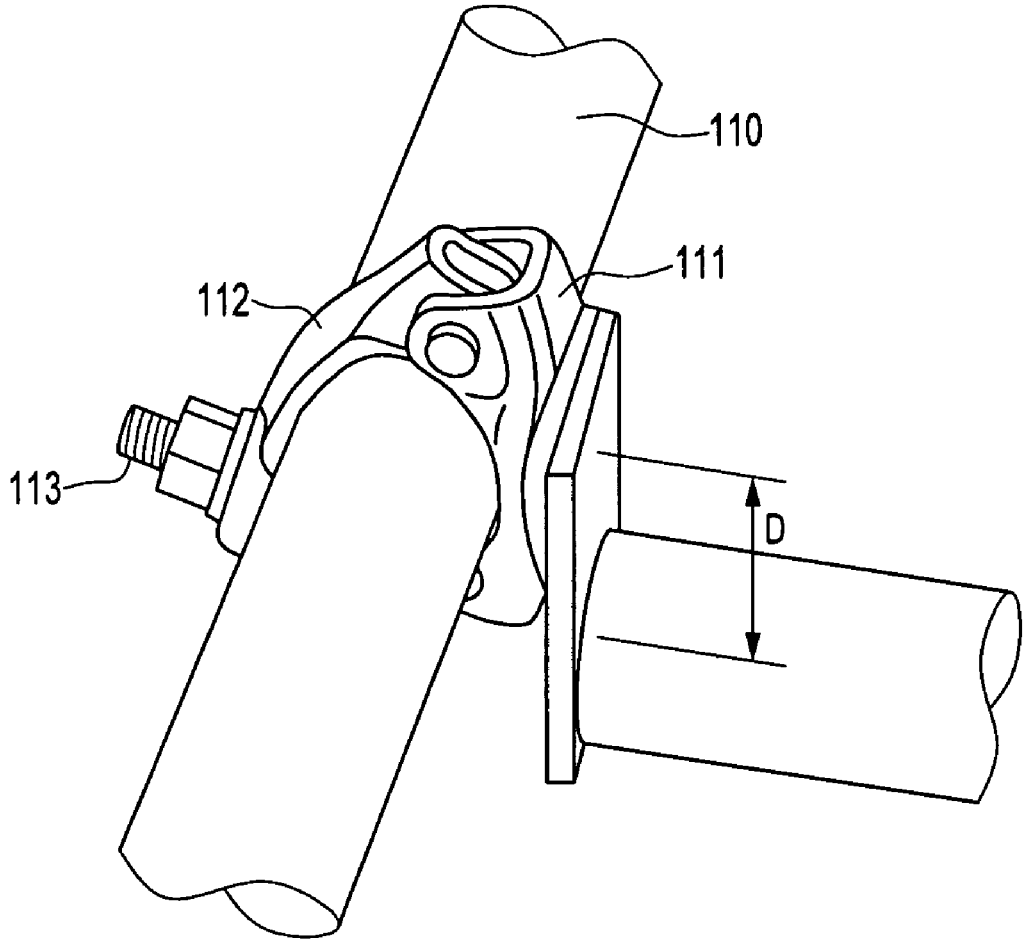
Figure 6C:
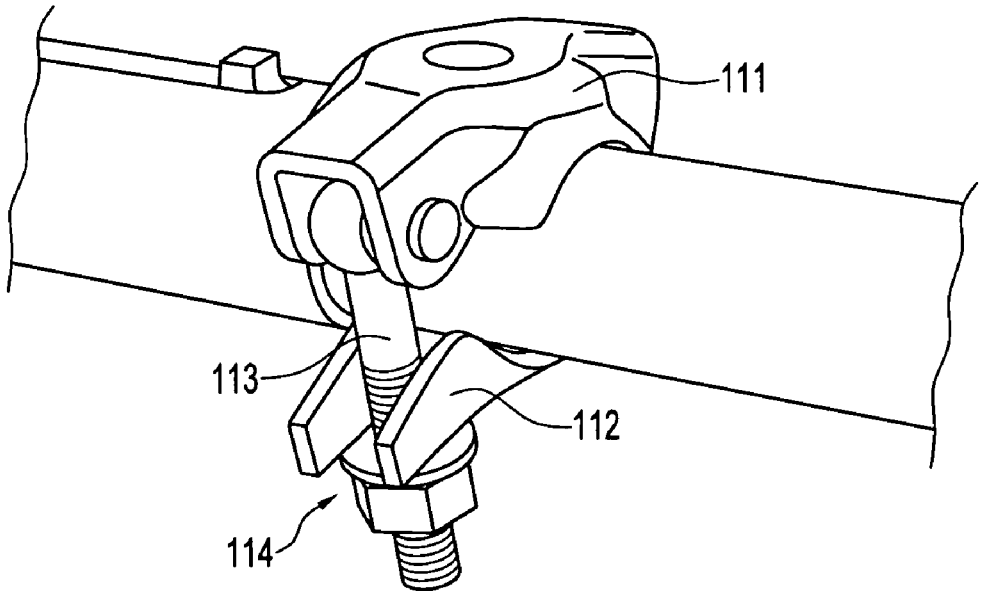

As shown in FIG. 4, the double barrel horizontal member 100 includes two attachment members 110 at opposing ends of the upper tube and lower tube: one at the exterior end of the upper tube 101 and one at the exterior end of the lower tube 102. "Exterior end" as used means the end of the tubes which are distal from double barrel structure 100 and attache to the scaffold frame. The attachment members 110 allow the double barrel horizontal member 100 to connect to the scaffold frame, preferably attachment to the horizontal scaffold members 3 on the scaffold frame. One type of attachment member is shown in FIGS. 6A and 6B. Shown is a clamp, having a first engagement surface 111, and a second engagement surface 112 pivotally attached to the first engagement surface 111 in a clam-shell like construction. The first and second engagement surfaces 111, 112 are adapted to latch around a horizontal scaffold member 3 and be fixed in position by a bolt 113 and nut. As shown in FIG. 6C, bolt 113 is pivotally mounted in one engagement surface (here, shown as upper engagement surface 111), and a lower threaded end of the bolt 113 is adapted to engage in an opening or slot 114 positioned in the other engagement surface. This arrangement allows the attachment member 110 to fixedly clamp to a horizontal scaffold member 3. This clam-shell type clamp will be referred to as a pivotal clamp means; removal of the pivoting clam-shell action (by securing the two sides of the clamping surfaces with bolts or the like) would also serve as a clamping attachment member. Another attachment member would include a channel or cutout (like a "U" shaped cutout of a scaffold board) in the end of the tubes and adapted to engage a horizontal member, either edge on (as in the scaffold boards), or end on, by mounting the U channel perpendicular to the tube. However, such an attachment member is not preferred as there is no latching or clamping structure to resist upward movement of the engaged attachment member.

If the double barreled horizontal member 100 is to attach to a vertical scaffold member, various attachment members are possible, such as the Williams latch.

As can be seen, the attachment member 110 on the insert tube 103 is vertically offset upwards a distance from the center-line of the insert tube 103 (also shown in FIG. 6B). The offset distance (measured vertically from the center of the attachment member 110 to the center of the lower tube 102) is distance D, the same distance by which the upper tube 101 is vertically offset from the lower tube 102. This vertical offsetting allows for vertical alignment of the attachment members 110 on the insert 103 and upper 101 tubes when attached to a scaffold frame so that both the upper tube 101 and lower tube 102 are level surfaces (that is, not tilted vertically) with respect to the horizontal scaffold members of the scaffold frame.

Figure 7:
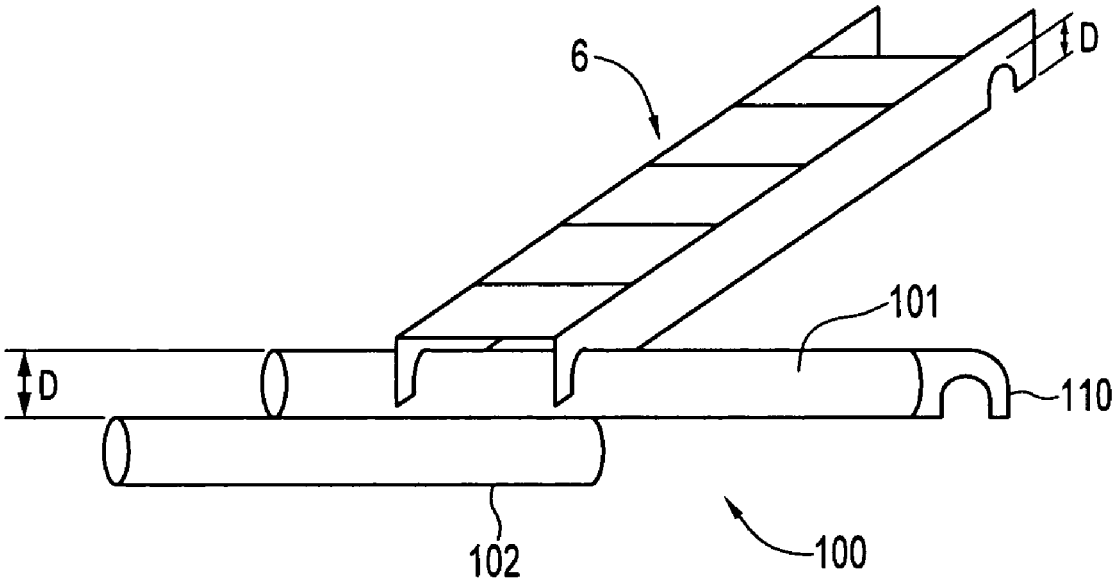
FIG. 7 is a perspective view of the access opening from the underside of the deck surface.

The offset distance "D" should be at least equal to the length of the side ears 9 on a metal scaffold plank 6. This distance allows the scaffold planks 6 (with side ears) to be placed across the upper 101 of the double barrel horizontal member 100 without interfering with the lower tube 102, as shown in FIG. 7. If the lower tube 102 diameter is smaller than that which would result in the desired offset distance, the lower tube 102 can be mounted to the upper tube 101 through a plate or plates 115 welded between the two tubes, as is shown in FIG. 3. To reduce weight, the lower tube could be a series of rings or short cylindrical pieces suspended below the upper tube to provide a mount for the insert tube to slide in (not shown). These rings or short cylindrical pieces should be of sufficient quantity to prevent the double barreled horizontal scaffold member from flexing in response to a downward force; that is, to allow the combination upper and lower (and insert) tubes to function substantially as a rigid single tube when installed.

As shown in FIG. 3, near the interior end 99 of the upper tube 101 is an outwardly projecting member 98, in this instance, a plate or plates. These plate(s) 98 are adapted to "block" scaffold boards 5 engaged on the upper tube from sliding off the interior end of the upper tube.

Also positioned near the interior end 99 of the upper tube 101 is a vertical stub 120. Vertical stub 120 is adapted to engage a short vertical scaffold member 200 (about 4 feet in length). Vertical stub 120 is a short 3–6" sleeve over which a vertical scaffold member 200 is slid. Vertical Stub 120 is shown in "dashed" outline in FIG. 3, as the short vertical scaffold member 200 is shown inserted over the vertical stub 120. Vertical stub 120 includes a button latch 121 in the stub's sidewalls adapted to engage an opening in the side walls of a vertical scaffold member 200 to latch the vertical stub 120 to the vertical scaffold member 200. Vertical stub 120 could be an oversized tube into which the vertical member 200 is inserted, (as opposed to inserting the stub into the vertical member) in which case, if a button latch is used, the button latch 121 must be located on the vertical scaffold member and aligning openings positioned in the vertical stub. Other means could be employed for latching the vertical stub 120 to a vertical scaffold member, such as a hitch pin, bolt, etc. In another embodiment, vertical stub 120 is an integral upstanding vertical scaffold member 200 (e.g. a upstanding vertical member welded onto upper tube 101); however, an integrated horizontal/vertical member (a "T" shaped scaffold member) is not preferred due to the bulkiness of this embodiment for shipping purposes.

Figure 9:
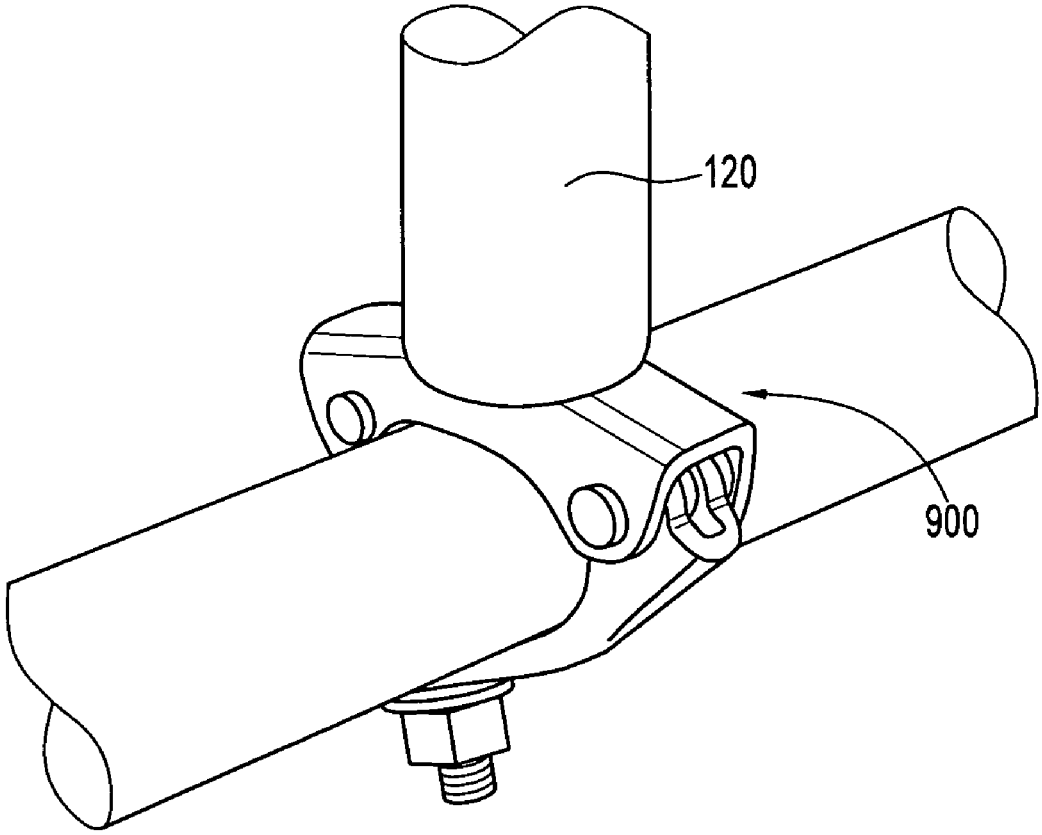
FIG. 9 is a perspective view of a detachable vertical stub or detachable short vertical scaffold member.
Figure 10:
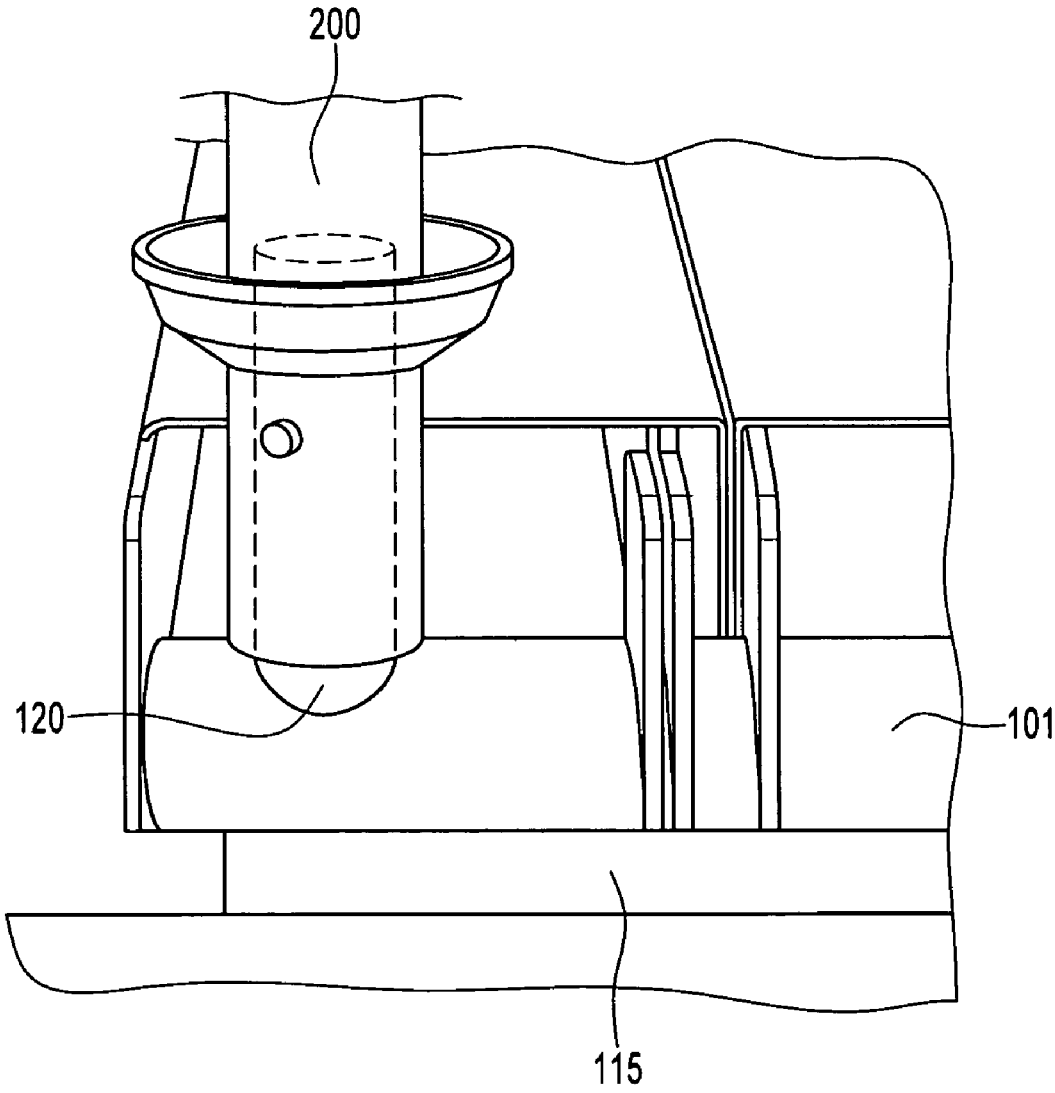
FIG. 10 is a close up perspective view of the upper tube and vertical stub.

As shown in the detail of FIG. 10, vertical stub 120 is welded to the top tube. An alternative embodiment could include a detachable vertical stub 120, such as a stub having an attachment member on its base, such as the pivotable clamp means 900 as shown in FIG. 9, or two such pivotable clamp means positioned on opposite sides of the stub (when employing a pivotable clamp means, the top and bottom tube should be joined by a vertical plate, where the plate is lacking or cutout in the area where the vertical stub 120 is attached to the upper tube 101 to allow the pivotable clamp means to encircle the upper tube 101). Alternatively, the upper tube 101 could incorporate a sleeve 300 on its top surface, where the detachable stub has a corresponding respective tab 301 or sleeve insertable into the corresponding structure on the upper tube, such as shown in FIG. 8. These are collectively referred to as a means for attaching a vertical scaffold member.

Figure 5:
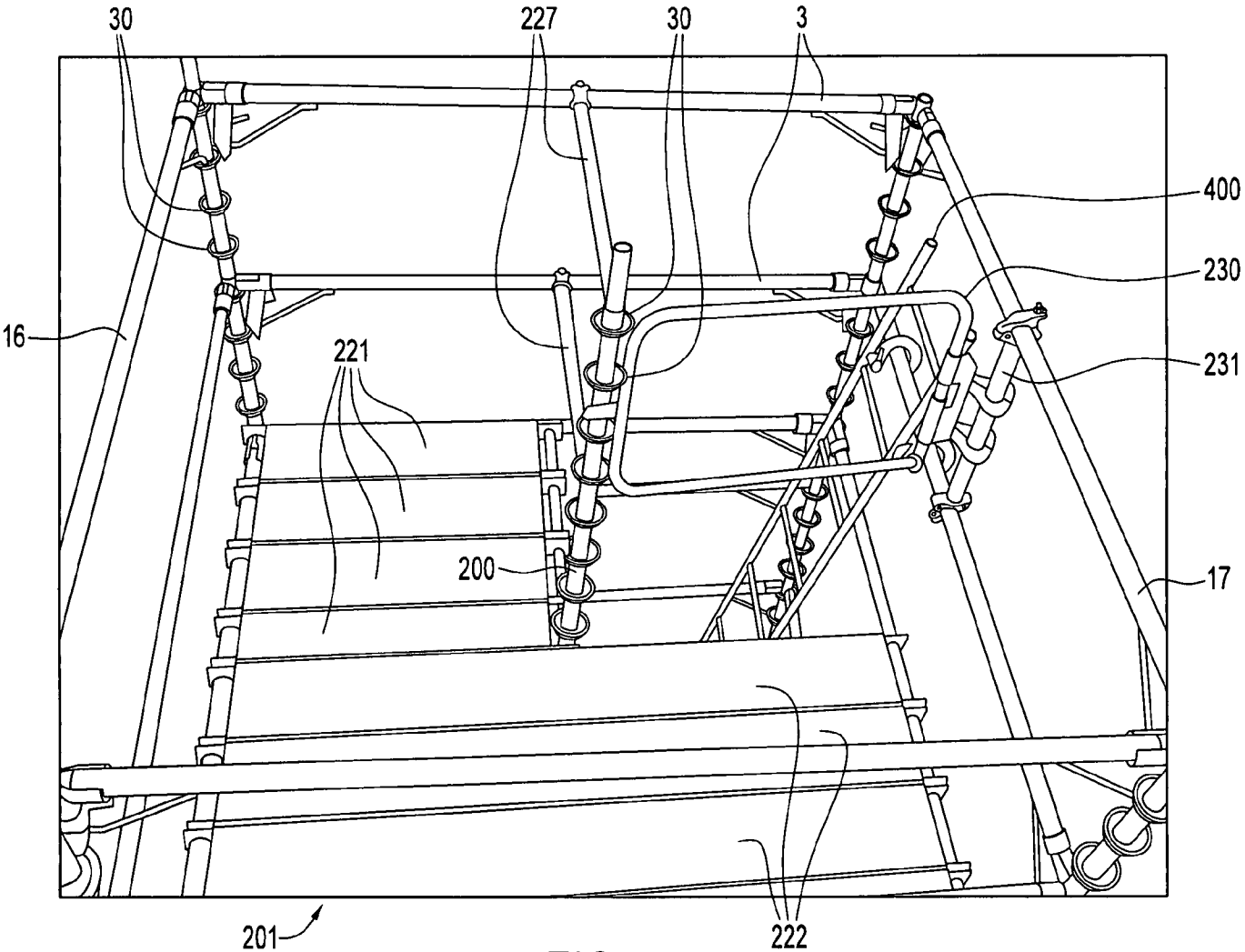
FIG. 5 is a top perspective view of the scaffold access system installed on a scaffold frame.

To create a scaffold deck 201 with an opening at a particular horizontal level, the double barrel horizontal tube 100 is adjusted to bridge across the scaffold frame at the desired horizontal level. As shown in FIG. 4, the double barrel horizontal member 100 bridges across the frame and engages horizontal members 3 in the scaffold frame creating an intermediary horizontal scaffold member. In the embodiment shown, the double barrel horizontal scaffold member 100 is positioned about 3.5 feet inside one of the vertical walls of the scaffold frame (the reference vertical wall 16). Short scaffold planks 221 are then installed across the upper tube 101 of the double barrel horizontal scaffold member 100 to a horizontal member on the scaffold vertical wall 17 opposite the reference vertical wall 16. As shown in FIG. 5, long scaffold boards 222 are then placed parallel to the short scaffold boards 221, but extending between the reference vertical wall 16 and the opposing vertical wall 17. These long scaffold boards 222 pass over the lower tube 102 of the double barrel horizontal scaffold member 100. This arrangement of scaffold planks creates a platform with an access opening 225 in a corner of the scaffold working deck. As shown in FIG. 5, the access opening 225 has two interior sides without a safety railing, and two exterior sides where the scaffold frame acts as a safety rail.

To create a safety rail system on the access opening 225 interior sides, a short vertical scaffold member 200 (about 4 feet in length) is positioned and locked on the vertical stub 120 of the upper tube 101 thereby forming an intermediate vertical member (intermediate in the sense that it is positioned internally to the scaffold structure, and the vertical member does not extend to the ground level). As shown in FIG. 5, the vertical scaffold member 200 has a series of cups 30 vertically positioned thereon. Short horizontal scaffold members 227 are then joined between the horizontal scaffold members 3 (which form the safety railing) and the intermediate vertical member 225, thereby creating a safety railing across one of the open sides of the access opening 225. The short horizontal members 227 utilized have a horizontal member with two ends with a latch adapted to engage a cup positioned on one end, and on the opposite end, the pivotable clamp means.

Figure 11:
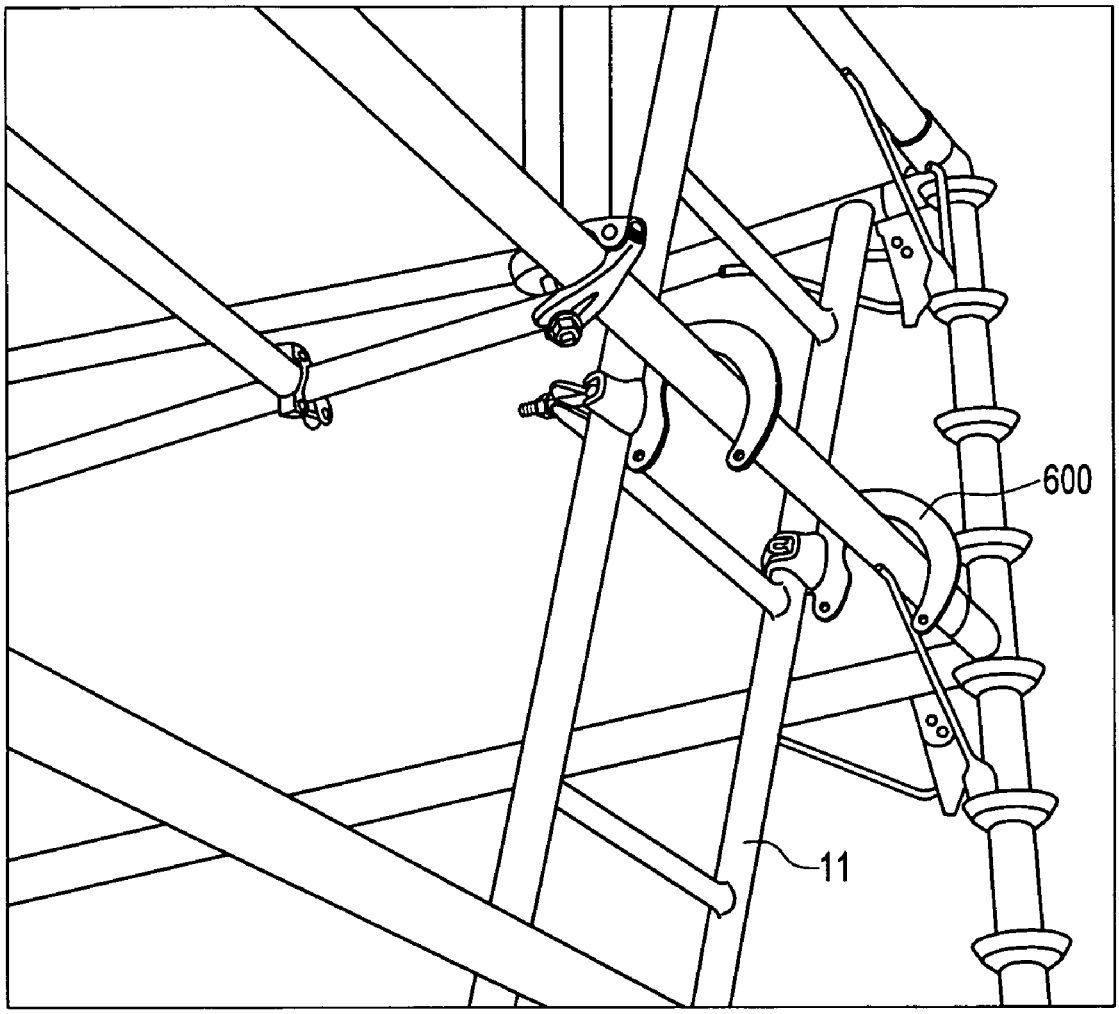
FIG. 11 is a perspective view of a scaffold ladder in the scaffold deck opening.

On the remaining open side of the access opening is placed a safety gate 230, shown in FIG. 5. Safety gate 230 is a pivoting spring loaded gate which is clamped to a short vertical member 231, which short vertical member 231 is then clamped between horizontal members 3 as shown in FIG. 5. Finally, a ladder 400 is positioned in the opening to allow access to the opening, preferably the ladder has a clamp such as the ladder clamp shown in U.S. Pat. No. 6,415,891, or hooks 600 to engage/clamp the ladder to the scaffold structure, as shown in FIG. 11. Alternatively, if the horizontal members of the scaffold frame are placed suitably, a separate ladder can be eliminated by employing the scaffold frame's horizontal members as the ladder's rungs. With this assembled structure, an opening is created in a scaffold deck which is fully protected by safety railing and the opening is accessible through the interior of the scaffold structure by a ladder. With multiple deck structures, openings can created in each deck to allow a worker to freely move about the scaffold's decks though interior access alone.

We claim:

1. In combination with a scaffold system having horizontal scaffold members and vertical scaffold members assembled into a frame, a scaffold deck access system comprising a double barrel scaffold horizontal member, a series of short scaffold boards, a series of long scaffold boards, a series of short horizontal members and a safety rail system, said double barrel scaffold horizontal member further comprising:

an upper tube and a lower tube assembly joined in a vertical relationship, said upper tube having an interior and an exterior end, and an upper attachment member positioned on said exterior end, said lower tube assembly having an exterior and interior ends and a lower attachment member positioned on said exterior end of said lower tube assembly, where said exterior end of said bottom tube assembly is distal from said exterior end of said upper tube;

said double barrel horizontal scaffold member being joined to said scaffold frame through said upper attachment member and said lower attachment member, and said series of short scaffold boards being positioned perpendicular to and between said upper tube and one of said horizontal scaffold members, said long scaffold boards being positioned parallel to said short scaffold boards and connecting from one of said horizontal members to a second opposing horizontal members, thereby defining a scaffold work surface with an access opening therethrough, and said safety rail system comprising:

a vertical stub attached to the interior end of said upper tube;

a short vertical scaffold member attached to said vertical stub;

one or more short horizontal members joined between the short vertical scaffold member and opposing horizontal scaffold members.

2. In combination with a scaffold system having horizontal scaffold members and vertical scaffold members assembled into a frame, the scaffold deck access system according to claim 1 further having a gate means to prevent access to the opening in scaffold work surface.

3. In combination with a scaffold system having horizontal scaffold members and vertical scaffold members assembled into a frame, the scaffold deck access system according to claim 2 whereby the gate means is comprised of a second short vertical scaffold member, said short vertical scaffold member connecting two horizontal scaffold members in the same plane and opposite the first short vertical scaffold member, and a pivoting gate attached to the second short vertical member.

4. In combination with a scaffold system having horizontal scaffold members and vertical scaffold members assembled into a frame, the scaffold deck access system according to claim 2 whereby a ladder is located inside the opening.

5. In combination with a scaffold system having horizontal scaffold members and vertical scaffold members assembled into a frame, the scaffold deck access system according to claim 4 whereby said ladder is engaged with the scaffold structure.

* * * * *